US005393946A

United States Patent [19]

DeLaHoz

[11] Patent Number: 5,393,946

[45] Date of Patent: Feb. 28, 1995

[54] WALL SWITCH PLATE ADAPTOR

[76] Inventor: Herman H. DeLaHoz, 2 Kent Pl., Sewell, N.J. 08080

[21] Appl. No.: 105,384

[22] Filed: Aug. 12, 1993

[51] Int. Cl.[6] ..... H01H 3/20

[52] U.S. Cl. ..... 200/331; 200/330; 200/329

[58] Field of Search ..... 200/331, 330, 332, 332.1, 200/332.2, 333, 329

[56] References Cited

U.S. PATENT DOCUMENTS

| | | | |
|---|---|---|---|
| 3,121,778 | 2/1964 | Sander et al. | 200/331 |
| 4,454,401 | 6/1984 | Powis, Jr. | 200/331 |
| 4,590,345 | 5/1986 | Marshell | 200/331 |
| 4,705,924 | 11/1987 | Hevoyan | 200/331 |

*Primary Examiner*—Henry J. Recla
*Assistant Examiner*—David J. Walczak
*Attorney, Agent, or Firm*—Robert D. Thompson

[57] ABSTRACT

The present invention relates to a wall switch plate adaptor for use by children or the disabled to turn off and on wall switches which are located above the reach of the potential user. The wall switch plate adaptor comprises a switch plate cover that includes raised areas to the left and right of the middle opening. These raised areas of the switch plate cover are used as guides for the flared edges wing-like projections at the end of an elongated member which projects a distance below the bottom edge of the switch plate cover. The wing-like projections fit in between the raised areas to the left and right of the opening in the switch plate cover. The top of the elongated member has a box channel shaped cross-section with flared edges forming wing-like projections and an opening in the center so the toggle switch can be put through when assembled. The wing-like projections at the end of the elongated member move in the space between the raised areas in the switch plate cover and the toggle switch bracket enabling the user to turn the wall switch on and off by pushing or pulling the lower end of the elongated member.

13 Claims, 1 Drawing Sheet

WALL SWITCH PLATE ADAPTOR

BACKGROUND OF THE INVENTION

This invention relates to on a wall switch plate with an elongated member used for turning the light on and off.

This invention combines two prior arts. The first prior art is a normal household wall switch plate. A wall switch plate has always been used to cover the electrical switch and the small area in the wall surrounding the switch.

The second prior art is a light switch extender. Certain department stores currently supply this product to the consumer. Although it has the means of extending the light switch there are many flaws. One example of presently marketed light switch extender has two cords coming down from the switch. The user must pull down on the proper cord to turn the light on or off. The problem with this is although both cords have indicators to which does what function, in the dark you can't see which cord to pull to turn the light on. Furthermore, over a time the cords will eventually begin to fray. If they break the whole device has to be replaced. Another disadvantage is that the product consists of a plastic cover which is attached over the existing wall switch plate and spans the entire width and length of the plate.

There is also another kind of extender which is attached over the switch plate also. This extender also covers the width and length of the switch plate but adds a plastic cartridge like casing that hangs down from the body of the device. Although both devices achieve the desired goal of allowing an unable person to operate the light switch, they entail a number of disadvantages:

(a) Both of these devices possess a higher cost to manufacture because of the greater amount of plastic needed.

(b) The use of cords for the first light switch extender promotes the possibility of fraying and wear on the cords over a period of time. If even one cord were to break it would be necessary to replace the entire unit.

(c) Each cord must be pulled in a downward motion to operate the device. In the dark one cannot see which cord is the correct one to pull.

(d) The second device with the plastic cartridge is about a foot in length. This would be an unsightly eyesore on any wall.

Furthermore, if the cartridge should break, again the entire device would have to be replaced.

Accordingly, besides the objects and advantages of enabling an unable individual to operate a light switch, by combining the two devices, the switch plate and the elongated member, several objects and advantages exist and they are:

(a) to provide a device that becomes a fixture to the wall rather than a separate entity;

(b) to provide a standard switch plate that can be used as an extender when the circumstances require and retain its normal use at all other times;

(c) to provide less of a necessity to use an abundance of plastic by just manufacturing the elongated member in durable and flexible plastic;

(d) to provide a direct connection to the toggle switch for standard operation by attaching the elongated member directly over the toggle switch; and (e) to provide the ability of replacement in case breakage by making the elongated member detachable and replaceable.

Further objects and advantages are to provide a device that can conserve energy and resources by manufacturing the elongated member with recycled plastic. Still further objects and advantages will become apparent from a consideration of the ensuing description and drawings.

BRIEF SUMMARY OF THE INVENTION

This invention provides a wall switch plate adaptor which enables the switch to be turned on or off by persons who cannot reach the toggle switch as it is mounted on the wall. The invention comprises a wall switch plate and an elongated member. The wall switch plate of standard $3'' \times 4\frac{3}{4}''$ size comprises an opening for the toggle switch which turns the power on and off with raised areas of the wall switch plate located at both vertical sides of the opening. The elongated member comprises an extended rod element of stiff material of a width equal to the width of the opening in the switch plate cover, projecting a desired distance below the bottom edge of the switch plate having at one end an end section of a length approximately one-half the length of the raised areas on the right and left of the opening on the wall switch plate. The end section of the elongated member has a box channel shaped cross-section with flared edges which form wing-like projections which extend to the sides beyond the width of the elongated member and a centered opening. The centered opening fits over the toggle switch and the wing-like projections of the channel shaped cross-section end of the elongated member fit under the raised sections of the wall switch plate adjacent to the switch opening. The switch is then operated by moving the elongated member up and down causing the wing-like projections to slide up and down within the raised areas adjacent to the toggle switch opening in the switch plate cover thereby moving the toggle switch up and down with the movement of the elongated member.

BRIEF DESCRIPTION OF SEVERAL VIEWS OF THE DRAWINGS

A more complete understanding of the invention and its advantages will be apparent from the detailed description taken in conjunction with the accompanying drawings in which.

DETAILED DESCRIPTION

Figure 3:
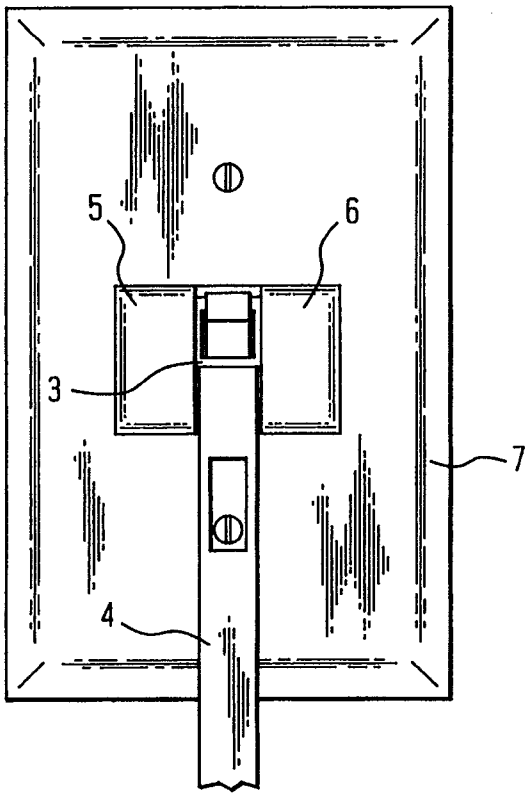
FIG. 3 shows the device in an assembled condition with a frontal view.
Figure 2:
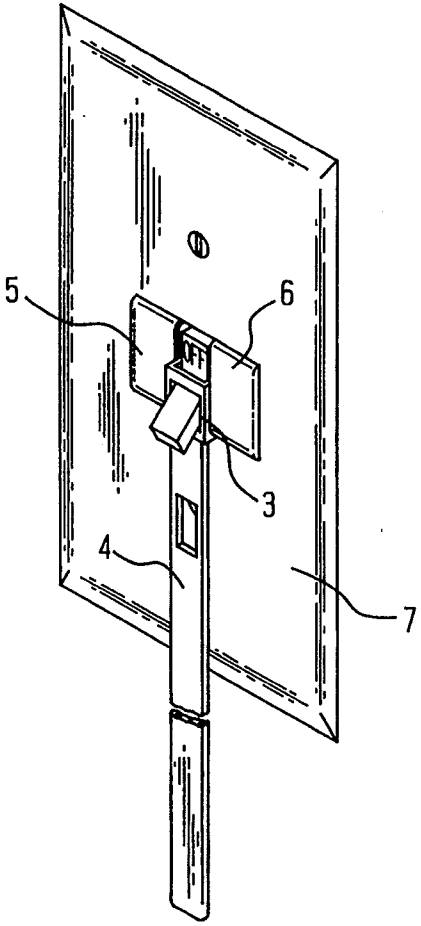
FIG. 2 is a schematic side view of the assembled apparatus.
Figure 1:
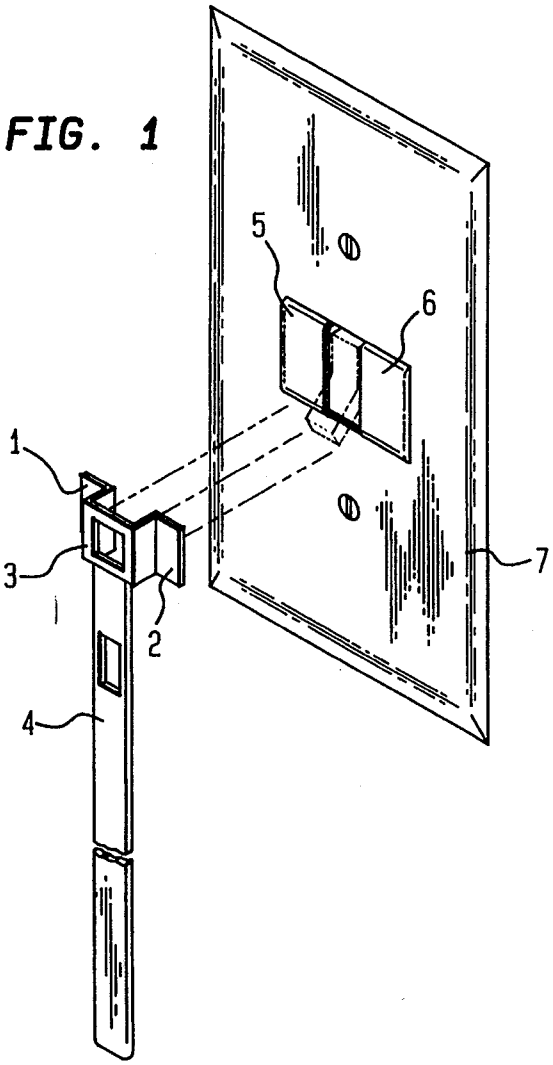
FIG. 1 is a schematic side exploded view of the apparatus.

The preferred wall switch plate adaptor in accordance with the present invention is made up of two pieces. One of the pieces is the wall switch plate 7 that includes a left raise area 5 and a right raised area 6 on the left and right sides of the opening in the wall switch plate where the toggle switch goes through as shown in FIG. 1. The other piece which connects to the wall switch plate 7 is the elongated member 4.

The elongated member 4 comprises an extended rod element projecting a desired distance below the bottom edge of the wall switch plate when assembled to the wall switch plate and an end section of a length of approximately one-half the length of the raised area to the left and right of the opening in the wall switch plate 5 and 6, said end section having a box channel shaped cross-section with flared edges forming wing-like projections 1 and 2 and a toggle switch opening 3 as shown in FIG. 1. The flared edges 1 and 2 fit behind the raised areas 5 and 6 of the wall switch plate 7 and move vertically within the raised areas 5 and 6.

The end section of elongated member has an opening in the center 3 so the toggle switch can be put through when assembled. The elongated member 4 also has an opening below the 3 so that the bottom screw of the wall switch plate 7 can be put through when assembled.

The wall switch plate 7 is attached to the wall over the toggle switch which fits through the opening 3 of the elongated member 4. The wing-like projections 1 and 2 are enclosed in the space formed between the back surfaces of the left and right raised areas 5 and 6 and the toggle switch bracket. The wing-like projections 1 and 2 rest on the outer most edge of the toggle switch bracket.

The elongated member may be made of preferably flexible or soft plastic for easy and inexpensive manufacturing. The switch plate can be made of the standard metal material used to make same.

From the description above, a number of advantages of my wall switch plate adaptor become evident:

(a) By implementing raised areas to the wall switch plate the plate, itself, is no longer just a cover for a hole in the wall. This device gives an individual the option of regular use of the light switch, or if circumstances change, one can purchase the elongated member as an accessory for the switch plate.

(b) In an assembled condition this device can enable toddlers and handicapped persons normal usage of a light switch. Toddlers will avoid any possible injury from use of a foot stool or another alike means one might use.

(c) Energy conservation can be more easily practiced as a toddler can learn early on to be responsible to turn a light on and off without adult intervention. It also will alleviate any assistance needed to a handicapped individual from an able bodied person.

The light is turned on by simply pushing the elongated member 4 up. The wing-like projections 1 and 2 fit up against the top backside of the raised areas 5 and 6 of the wall switch plate 7 to follow the travel or movement of the toggle switch as it moves to the 'one' position. The toggle switch turned off by pulling the elongated member 4 of the device down.

The raised areas 5 and 6 of the wall switch plate 7 with the toggle switch bracket, enclose the wing-like projections 1 and 2 and provide an area for their vertical travel. The instant invention has an added advantage of leaving the toggle switch exposed so that it can be used in the conventional manner when the wall switch plate adaptor is in place. The invention does not include an additional switch enclosing the wall toggle switch thereby reducing manufacturing costs and maintenance.

Accordingly, the reader will see by implementing raised areas to the switch plate and using the elongated member, the wall switch plate will provide toddlers and handicapped persons the capability to use a light switch without any assistance by an able person. This device will ultimately conserve energy because the user will not have to wait for an able person to come and turn the light off.

It is apparent that modifications in the exemplary structure described above can be made by those skilled in the art without departing from the use and the parts of the invention and the invention is not to be considered limited to what is shown in the drawings and described in the specification.

I claim:

1. A wall switch plate adaptor device for assisting an unabled person to have normal use of a toggle switch comprising a modified wall switch plate attachable to an existing toggle switch, said modified wall switch plate having an opening of a shape and size slightly larger than a cross section of the toggle switch and raised areas on opposite sides of the opening and an elongated member comprising an extended rod element projecting a desired distance below the bottom edge of the switch plate when assembled to the switch plate and a protruding end section of a length approximately one-half a length of the raised areas of the switch plate, said end section having a box channel shaped cross-section with a width equal to a width of the opening in the switch plate and flared edges forming wing-like projections, said end section also having an opening of a shape and size slightly larger than the cross-section of the toggle switch, whereby the toggle switch fits through the opening and is exposed for activation in a conventional manner and the wing-like projections fit behind the raised areas of the switch plate and move vertically within the space formed beneath the raised areas as the toggle switch moves up and down.

2. The wall switch plate adaptor of claim 1 wherein said wall switch plate contains raised areas on each vertical side of center opening for toggle switch.

3. The invention of claim 1 wherein said raised areas serve as a means of connection of said elongated member to said wall switch plate.

4. The invention of claim 1 wherein said elongated member is made of hard yet flexible plastic.

5. The invention of claim 1 wherein said elongated member is made of sufficient length and width so to accommodate unable persons with normal use.

6. The invention of claim 1 wherein said elongated member has an end section having a box channel shaped cross section with flared edges forming wing-like projections at top of said elongated member.

7. The invention of claim 1 wherein said end section having a box channel shaped cross-section with an opening which encases said toggle switch.

8. The invention of claim 1, further including two wing-like projections at the end of said elongated member.

9. The invention of claim 8 wherein said wing-like projections are a means of connection to the under side of said raised areas of said wall switch plate.

10. The invention of claim 8 wherein the inner back corner of each side of said wing-like projection sits snugly on the outer most edges of the switch plate.

11. The invention of claim 8 wherein said wing-like projections are flush against the under side of said raised areas of said wall switch plate.

12. The invention of claim 8 wherein said wing-like projections slide in an up and down motion to keep in accordance with said toggle switch.

13. The invention of claim 1 wherein said raised areas of said wall switch plate are a means of guidance and stability to said wing-like projections at end of said elongated member.

* * * * *